US008451197B2

(12) United States Patent
Nakamura et al.

(10) Patent No.: US 8,451,197 B2
(45) Date of Patent: May 28, 2013

(54) INFORMATION DISPLAY APPARATUS HAVING A PLURALITY OF THIN-FILM LIGHT-EMITTING DIODES

(75) Inventors: Yukio Nakamura, Hachioji (JP); Hiroshi Toyama, Hachioji (JP)

(73) Assignee: Oki Data Corporation, Tokyo (JP)

( * ) Notice: Subject to any disclaimer, the term of this patent is extended or adjusted under 35 U.S.C. 154(b) by 1493 days.

(21) Appl. No.: 12/037,174

(22) Filed: Feb. 26, 2008

(65) Prior Publication Data

US 2008/0211413 A1 Sep. 4, 2008

(30) Foreign Application Priority Data

Feb. 28, 2007 (JP) ..... 2007-049026

(51) Int. Cl.
*G09G 3/32* (2006.01)

(52) U.S. Cl.
USPC ..... 345/82

(58) Field of Classification Search
USPC ..... 345/76–83; 313/498–505; 257/59–92; 315/169.1–169.3; 347/237; 438/45
See application file for complete search history.

(56) References Cited

U.S. PATENT DOCUMENTS

| | | | | |
|---|---|---|---|---|
| 2003/0020084 | A1* | 1/2003 | Fan et al. | 257/92 |
| 2004/0263443 | A1* | 12/2004 | Shirasaki | 345/76 |
| 2006/0061524 | A1* | 3/2006 | Suh et al. | 345/76 |
| 2007/0075936 | A1* | 4/2007 | Kim | 345/76 |
| 2007/0273778 | A1* | 11/2007 | Hsu et al. | 348/294 |
| 2009/0118007 | A1* | 5/2009 | Nakaya | 463/31 |

FOREIGN PATENT DOCUMENTS

JP 2000-089694 A 3/2000

* cited by examiner

*Primary Examiner* — Rodney Amadiz
(74) *Attorney, Agent, or Firm* — Panitch Schwarze Belisario & Nadel LLP

(57) ABSTRACT

An information display apparatus includes a matrix of thin-film light-emitting diodes (LEDs) disposed on a transparent substrate. The thin-film LEDs are epitaxially grown on a semiconductor substrate, then transferred in strips to the transparent substrate, anchored by intermolecular forces, and separated into individual LEDs by photolithography and etching. The anodes and cathodes of the thin-film LEDs are connected to anode and cathode driving circuits by a matrix of thin-film electrical paths formed on the transparent substrate. The matrix of LEDs and interconnections is dense enough to display images of high quality, and provides enough pixels for the display of useful text and graphics on even small information display devices.

21 Claims, 13 Drawing Sheets

INFORMATION DISPLAY APPARATUS HAVING A PLURALITY OF THIN-FILM LIGHT-EMITTING DIODES

BACKGROUND OF THE INVENTION

1. Field of the Invention

The present invention relates to an information display apparatus with a matrix of light-emitting diode picture elements (LED pixels).

2. Description of the Related Art

Vast numbers of information display devices with LED pixels are now in use, displaying public transportation destinations, for example. These devices comprise a large number of LED chips arranged in a matrix on an insulating substrate. The LED chips are switched on and off by a driving circuit disposed on the opposite side of the substrate to display text and graphics. The numerous LEDs in the matrix are individually die-bonded to the insulating substrate, then bonded by metal wires to electrodes on the surface of the insulating substrate, and finally covered with transparent plastic to provide a flat display surface.

A display device of this type is described in Japanese Patent Application Publication No. 2000-089694.

In these conventional information display devices, because the LED chips must be individually die-bonded and wire-bonded, a dense matrix of LEDs cannot be formed. The display therefore appears grainy, with strikingly poor image quality. A further drawback of these conventional LED matrices is that they are impractical for small information display devices, because they do not provide enough pixels to display useful text or graphics.

SUMMARY OF THE INVENTION

An object of the present invention is to create a high-density LED pixel matrix, thereby improving the image quality of LED information display devices, and enabling LED pixel matrices to be used in small as well as large information display devices.

The invented information display apparatus comprises a plurality of thin-film LEDs formed in a matrix on a transparent substrate, a matrix of anode thin-film electrical paths and cathode thin-film electrical paths connected to the anodes and cathodes of the thin-film LEDs, an anode driving circuit for controllably supplying current to the thin-film LEDs through the anode thin-film electrical paths, and a cathode driving circuit for controllably sinking current from the thin-film LEDs through the cathode thin-film electrical paths.

The thin-film LEDs are small in size, and a high-density matrix can be formed by anchoring thin-film strips to the transparent substrate and then etching the strips to form the individual LEDs. The anode and cathode thin-film electrical paths are formed in separate layers by fine-patterning techniques that can create a high-density matrix of interconnections. The invented information display apparatus can therefore provide a dense pixel matrix that delivers vastly improved image quality, and can provide enough pixels for the display of useful text and graphics on even small information display devices.

DETAILED DESCRIPTION OF THE INVENTION

Figure 1:
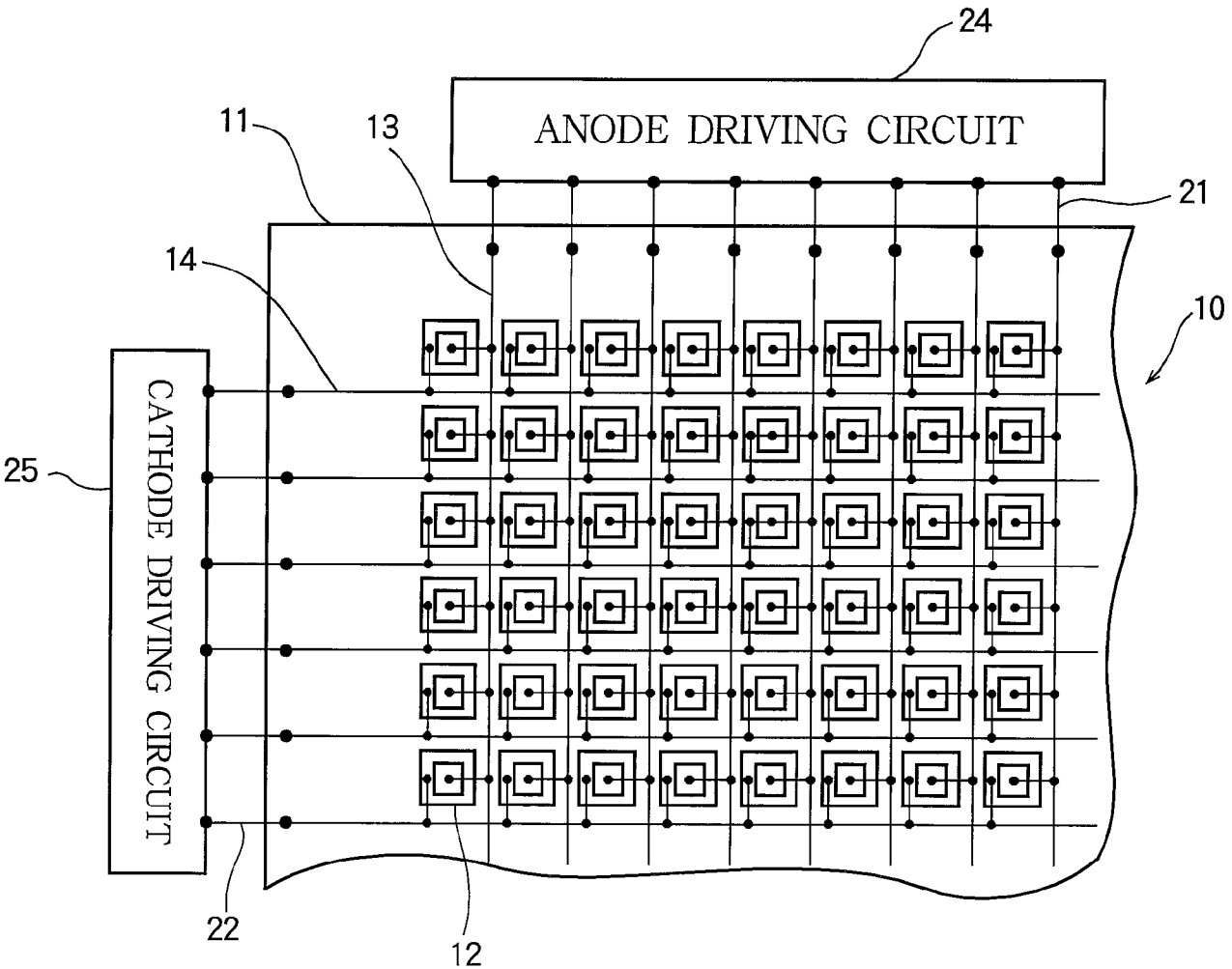
FIG. 1 is an enlarged plan view of a display panel according to a first embodiment of the invention.

Embodiments of the invention will now be described with reference to the attached drawings, in which like elements are indicated by like reference characters.

First Embodiment

First, the structure of a novel display panel used in the invented information display apparatus will be described, and its fabrication will be outlined. A detailed description will then be given of the structure and functions of an information display apparatus including this display panel.

Referring to FIG. 1, the display panel 10 comprises a glass substrate 11, thin-film LEDs 12, anode wiring 13, cathode wiring 14, an anode wiring sheet 21, and a cathode wiring sheet 22. The glass substrate 11 is a transparent glass sheet. The thin-film LEDs 12 form an M×N matrix on the glass substrate 11, where M and N are positive integers. The anode wiring 13 comprises thin-film electrical paths connected to the anodes of the thin-film LEDs 12 on the glass substrate 11. The cathode wiring 14 comprises thin-film electrical paths connected to the cathodes of the thin-film LEDs 12 on the glass substrate 11. The anode wiring sheet 21 and cathode wiring sheet 22 comprise copper thin-film wiring formed on a sheet of a dielectric material such as polyimide or polyester. The anode wiring sheet 21 connects the anode wiring 13 to an anode driving circuit 24; the cathode wiring sheet 22 connects the cathode wiring 14 to a cathode driving circuit 25.

The glass substrate 11 is glass or quartz panel with one major surface covered by an insulating film (not shown) on which the thin-film LEDs 12 are disposed. The insulating film may comprise an organic material such as polyimide or an inorganic material such as silicon oxide. To provide a smooth and flat surface, the insulating film is planarized, preferably to a flatness tolerance of at most a few tens of nanometers.

For a red light-emitting matrix, the thin-film LEDs 12 are multilayer thin films formed of inorganic semiconductor materials that combine to emit light with a wavelength of 620 to 710 nanometers. Examples of such semiconductor materials include aluminum gallium arsenide and indium aluminum gallium arsenide, although other materials may be used instead. The thin-film LEDs 12 may have, for example, a heterostructure or double heterostructure.

The anode wiring 13 and the cathode wiring 14 are thin-film patterns of electrical paths formed on the glass substrate 11, making electrical contact with the anode and cathode, respectively, of each thin-film LED 12. The anode wiring 13 and cathode wiring 14 may be formed from thin films of gold or aluminum, and may also include layers of another metal such as nickel or titanium.

The anode wiring sheet 21 and cathode wiring sheet 22 are copper thin-film wiring patterns formed on an insulating film made of a material such as polyimide or polyester, bonded at one end to the anode wiring 13 or cathode wiring 14 on the glass substrate 11, and at the other end to wiring patterns (not shown) on a wiring board (shown and described later). The wiring may be bonded by solder bonding, pressure bonding, or any other suitable bonding technique.

Detailed descriptions of the anode driving circuit 24 and cathode driving circuit 25 will be given later.

Matrices of green and blue thin-film LEDs 12 may also be formed on the glass substrate 11. The matrix structure is the same as described above, but for a green light-emitting matrix the thin-film LEDs 12 are formed from an inorganic semiconductor material such as aluminum gallium indium phosphide or gallium phosphide that emits green light, and for a blue light-emitting matrix, the thin-film LEDs 12 are formed from an inorganic semiconductor material such as gallium nitride or indium gallium nitride that emits blue light. Other light-emitting materials may also be used, but the green thin-film LEDs 12 should emit light at a wavelength of 500 to 580 nanometers and the blue thin-film LEDs 12 should emit light at a wavelength of 450 to 500 nanometers.

For a full-color display, red, green, and blue thin-film LEDs 12 may be disposed on a single glass substrate 11. For a monochrome or two-color display, thin-film LEDs 12 of only one or two colors may be used.

Regardless of the color of light emitted, the thin-film LEDs 12 are formed by epitaxial growth on a semiconductor substrate, then separated from the semiconductor substrate and anchored to the glass substrate 11 by intermolecular forces such as hydrogen bonds. The LEDs 12 are preferably attached to the glass substrate 11 in strips, which are then etched to form the individual LEDs. It is convenient if each column of N LEDs in the matrix can be formed from a single strip. The process of forming and attaching the LEDs will be described under this assumption with reference to FIGS. 2 to 4.

Figure 2:
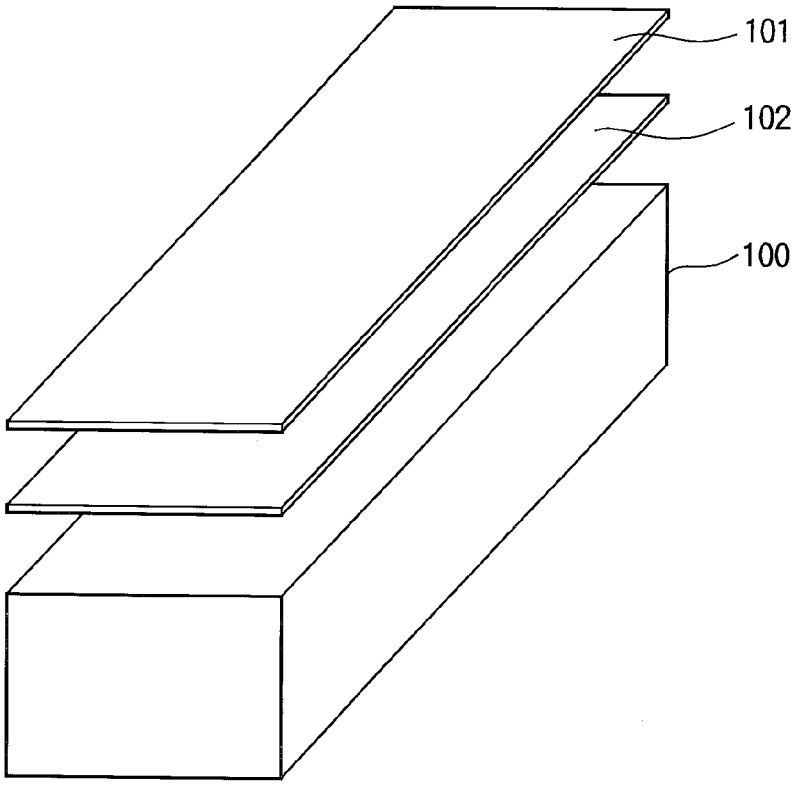
FIG. 2 is a drawing schematically illustrating the formation an LED thin film.

Referring to FIG. 2, N thin-film LEDs 12 are formed in a strip comprising a semiconductor substrate 100, an LED thin film 101, and a sacrificial layer 102. The LED thin film 101 has the light-emitting structure described above: for example, a heterostructure or a double heterostructure including layers of aluminum gallium arsenide or indium aluminum gallium arsenide. The sacrificial layer 102 is a layer of a similar but more readily etchable material such as aluminum arsenide, for example, disposed between the LED thin film 101 and the semiconductor substrate 100.

The semiconductor substrate 100 is made of, for example, gallium arsenide. The LED thin film 101 and sacrificial layer 102 are epitaxially grown on this substrate 100 by a vapor-phase method such as metal organic chemical vapor deposition (MOCVD). The LED thin film 101 and sacrificial layer 102 are originally grown on a generally round gallium arsenide wafer, but before the LED thin film 101 is separated from the substrate 100, the substrate 100, including the LED thin film 101 and sacrificial layer 102, is divided into strips wider than the width of the thin-film LEDs 12 that will be formed. If the thin-film LEDs 12 have a 0.1-mm square shape, for example, the strip shown in FIG. 2 has a width exceeding 0.1 mm. The length of the strip should also exceed the length of a column of N thin-film LEDs 12 in the matrix that will be formed on the glass substrate 11.

Strips of this shape are formed by photolithography and etching techniques widely used in semiconductor fabrication processes. A suitable etchant is a solution of phosphoric acid and hydrogen peroxide. After strip formation, the strips are dipped into a different etchant such as a hydrogen fluoride solution or hydrochloric acid solution to etch the sacrificial layer 102 and thereby separate the LED thin film 101 from the substrate 100.

Figure 3:
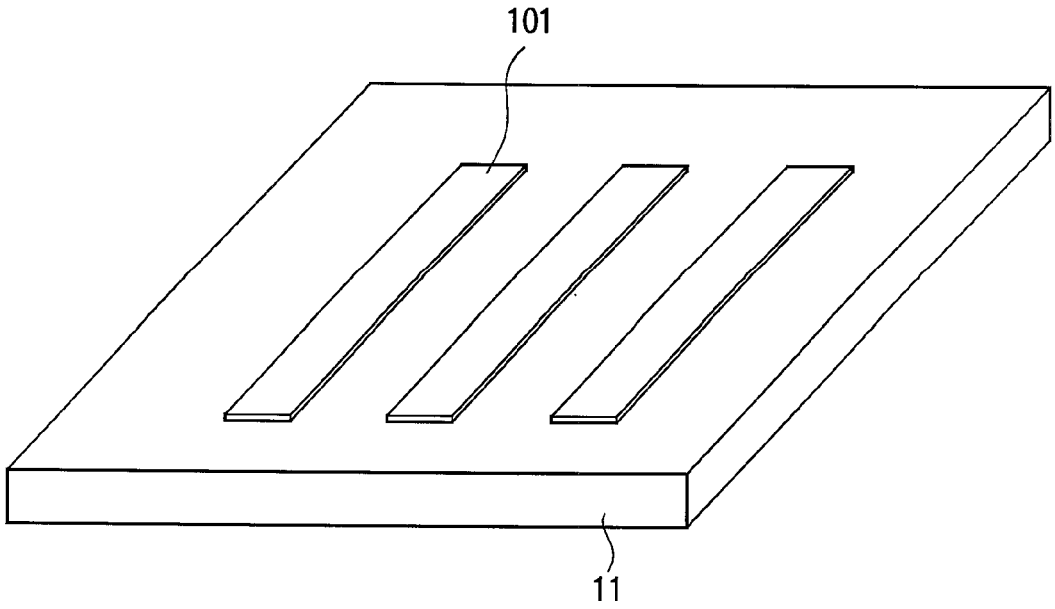
FIG. 3 is a drawing schematically illustrating the bonding of LED thin-film strips onto a glass sheet.

The detached LED thin-film strips 101 are pressed onto the planarized glass substrate 11 and anchored by intermolecular forces such as hydrogen bonds in a side-by-side pattern as shown schematically in FIG. 3. The smooth, flat surface of the organic or inorganic insulating film covering the top surface of the glass substrate 11 facilitates the hydrogen-bonding of the LED thin-film strips 101.

Figure 4:
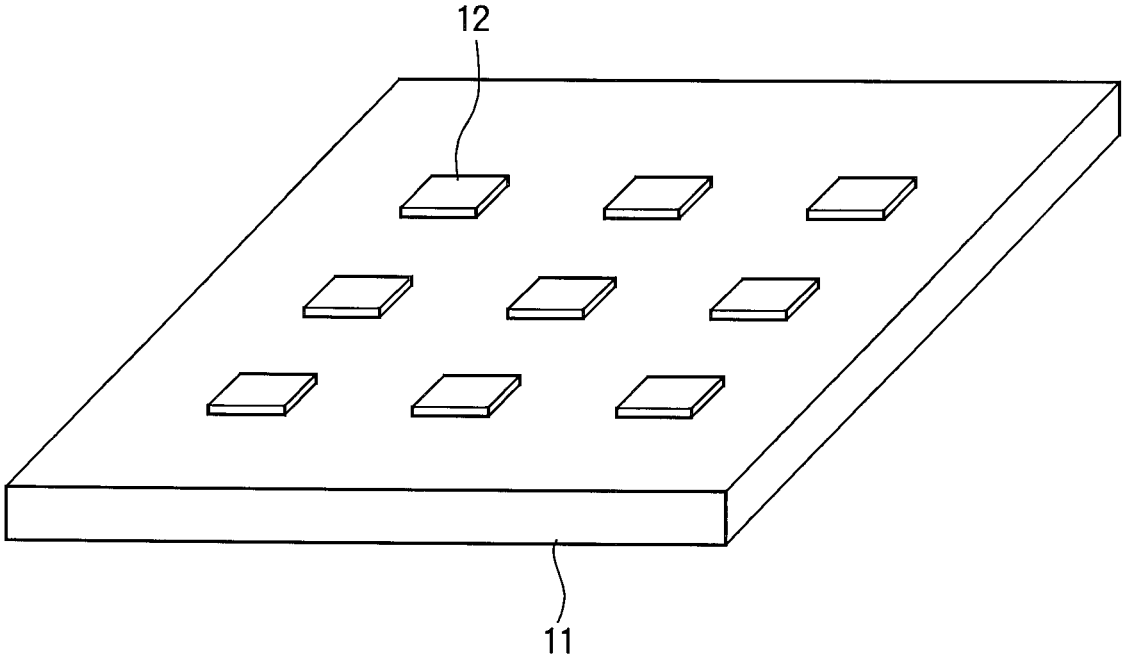
FIG. 4 is a drawing schematically illustrating the formation of discrete LEDs on the glass sheet.

The LED thin film strips 101 anchored to the glass substrate 11 are now patterned by photolithography and etching using, for example, phosphoric acid and hydrogen peroxide as an etchant, to form an M×N matrix of discrete thin-film LEDs 12 as shown schematically in FIG. 4. The anode wiring 13 (not shown) is then formed by a process including evaporation deposition, followed by photolithography and etching or lift-off. The anode wiring 13 comprises M anode lines, each connected in parallel to the anodes of N thin-film LEDs 12. Subsequently, an insulating film such as an aluminum oxide or polyimide film is deposited on the anode wiring 13, and then the cathode wiring 14 (not shown) is formed by evaporation deposition and photolithography followed by etching or lift-off. The cathode wiring 14 comprises N cathode lines, each connected in parallel to the cathodes of M thin-film LEDs 12.

A description will now be given of the structure and operation of an information display apparatus 50 including the above display panel 10.

Figure 5:
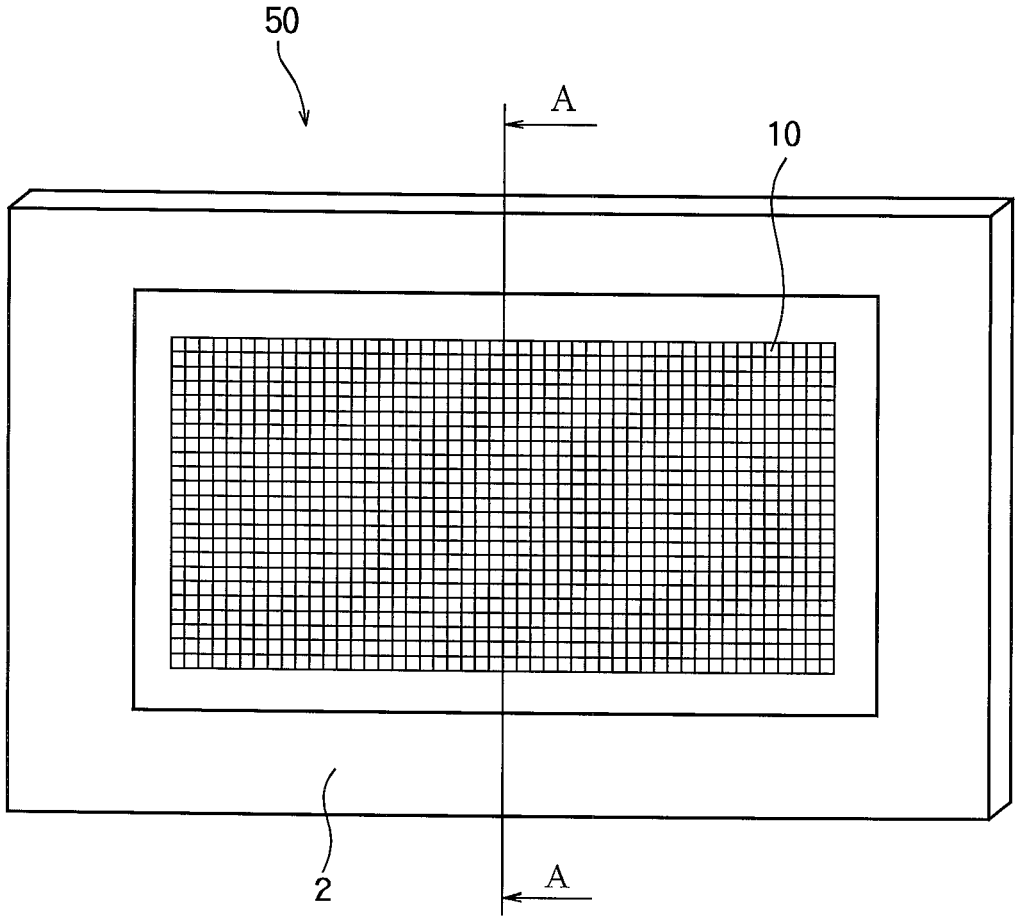
FIG. 5 is a perspective view of an information display apparatus according to the first embodiment.

Referring to FIG. 5, in the first embodiment the information display apparatus 50 comprises the display panel 10 described above, which is attached to a chassis 2 made of, for example, a plastic material functioning as the housing of the apparatus.

Figure 6:
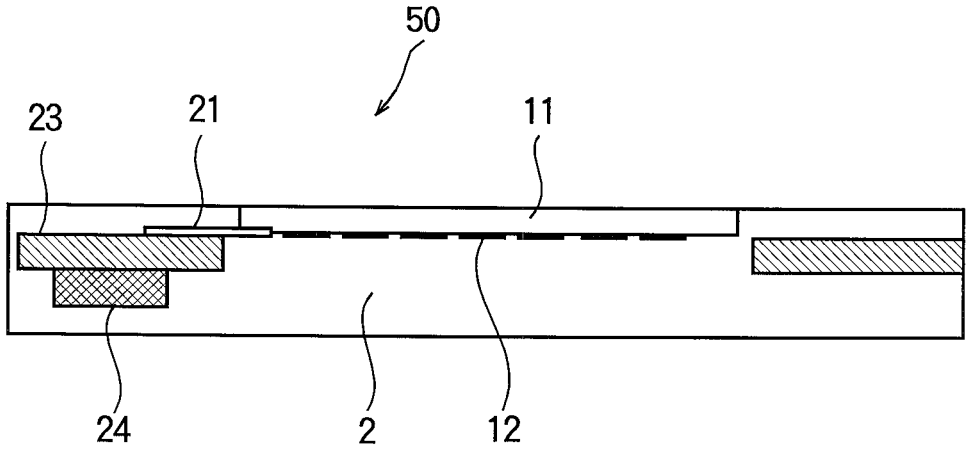
FIG. 6 is a sectional view of the information display apparatus in FIG. 5.

Referring to FIG. 6, the thin-film LEDs 12 are disposed on the underside of the glass substrate 11, which is the side facing the chassis 2. The anode wiring sheet 21 connects the thin-film LEDs 12 to a wiring board 23 held in the chassis 2. The anode driving circuit 24 is mounted on the underside of the wiring board 23, and is connected to the anode wiring sheet 21 through via holes (not shown) in the wiring board 23.

Though not shown in FIG. 6, the cathode driving circuit 25 is similarly mounted on the wiring board 23 and connected to the cathode wiring sheet 22.

Figure 7:
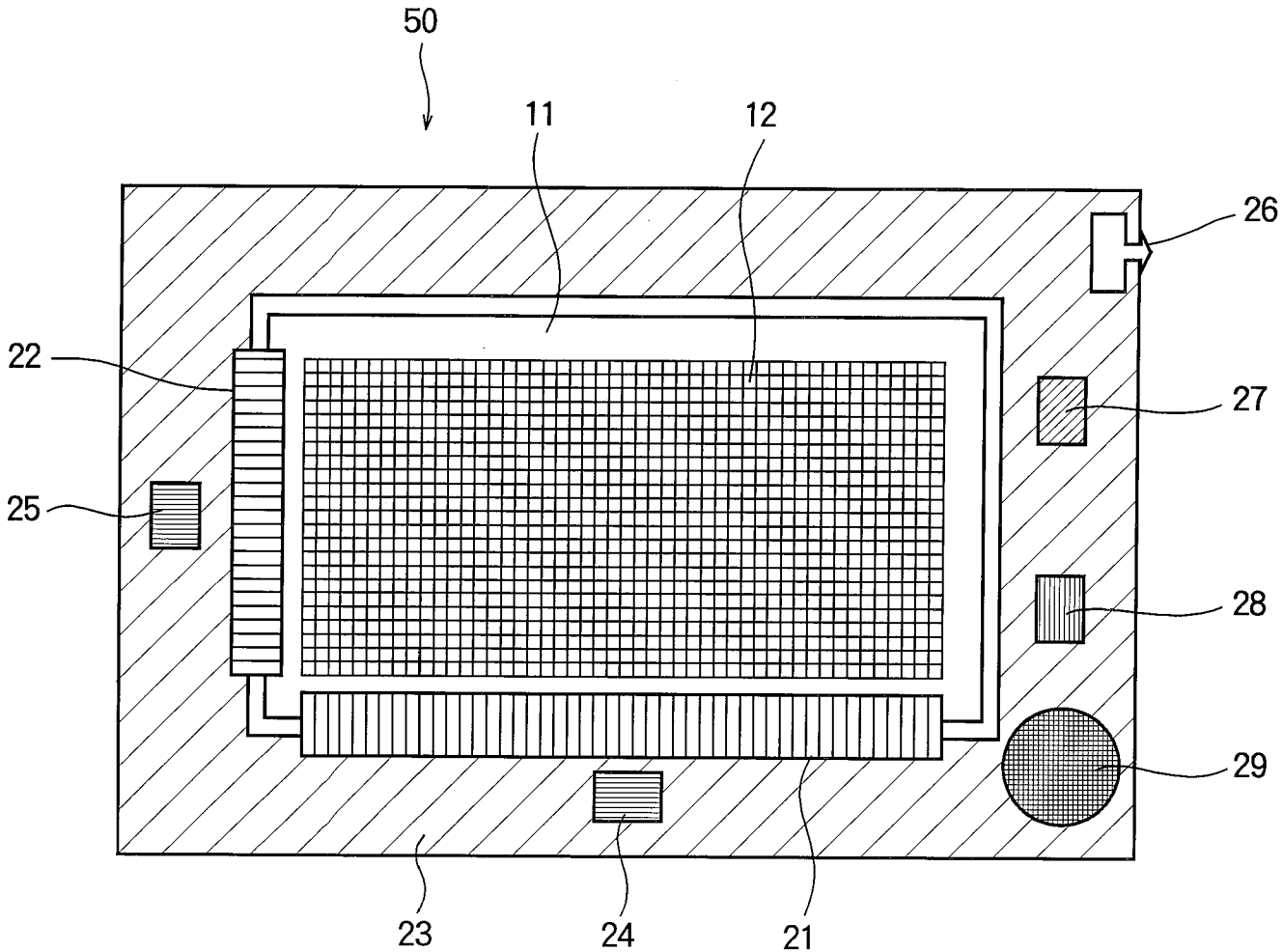
FIG. 7 is a plan view of the information display apparatus in FIG. 5 with its chassis removed.

Referring to FIG. 7, in addition to the anode driving circuit 24 and cathode driving circuit 25, an input terminal 26, an image control circuit 27, a memory circuit 28, and a power supply 29 are also mounted on the wiring board 23. These circuits 24-29 are interconnected by wiring patterns (not shown) formed on the wiring board 23. The mounting and electrical connections may be effected by soldering.

Figure 8:
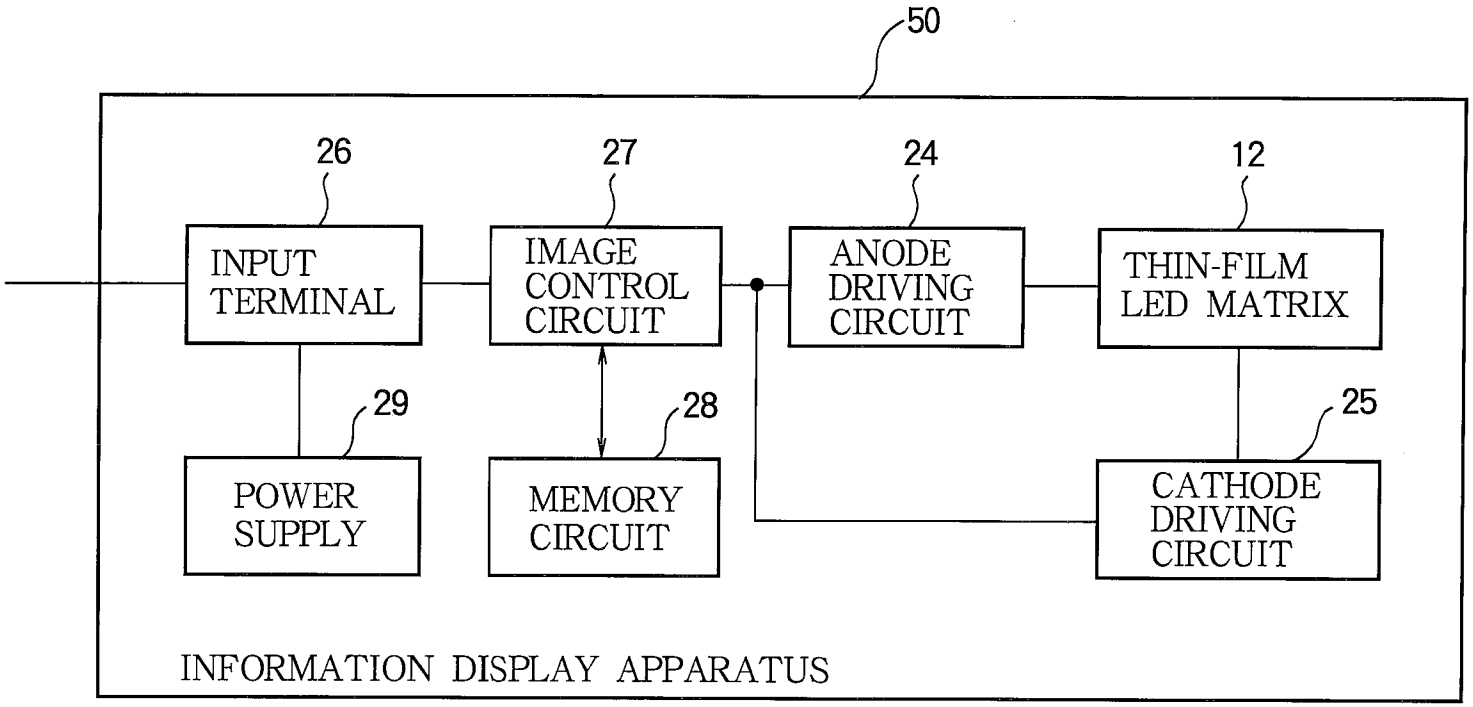
FIG. 8 is a circuit block diagram of the information display apparatus in FIG. 5.

FIG. 8 illustrates the interconnections among the matrix of thin-film LEDs 12, the anode driving circuit 24, the cathode driving circuit 25, the input terminal 26, the image control circuit 27, the memory circuit 28, and the power supply 29 in block diagram form.

The input terminal 26 is, for example, a universal serial bus (USB) connector for receiving signals and power from an external USB-compatible device such as a personal computer. The image control circuit 27 controls the anode driving circuit 24, cathode driving circuit 25, and memory circuit 28 according to data received from the input terminal 26. The memory circuit 28 is a readable and writable memory circuit such as a random access memory (RAM).

The anode driving circuit 24 has the function of supplying driving current through the anode wiring 13 to the thin-film LEDs 12 according to image signal data received from the image control circuit 27. The anode driving circuit 24 includes a shift register and latch circuits for storing the image signal data, amplifier circuitry, and switchable constant current circuitry (all not shown). The switchable constant current circuitry is connected through the anode wiring sheet 21 to the anode wiring 13 formed on the glass substrate 11 and thus to the anodes of the thin-film LEDs 12.

The cathode driving circuit 25 has the function of scanning the matrix of thin-film LEDs 12 by selecting one cathode line at a time in the cathode wiring 14 formed on the glass substrate 11, according to control signals received from the image control circuit 27. The cathode driving circuit 25 is connected to the cathode wiring 14 through the cathode wiring sheet 22.

The power supply 29 includes a battery such as a lithium battery, for example, that supplies power to the anode driving circuit 24, cathode driving circuit 25, image control circuit 27, and memory circuit 28. The power interconnections have been omitted from FIG. 8 for simplicity. The power supplied to the anode driving circuit 24 includes power for driving the thin-film LEDs 12. The power supply 29 can be switched on and off by a switch (not shown), and is chargeable through the input terminal 26, as indicated.

The operation of the information display apparatus 50 will be described with reference to FIG. 8. Three operations will be described: (1) storing image data in the memory circuit 28; (2) reading image data from the memory circuit 28 and driving the thin-film LEDs 12 in the display panel 10; and (3) charging the power supply 29 from an external power source.

(1) Image data are stored in the memory circuit 28 as follows.

First, the power supply 29 is switched on to supply power to the anode driving circuit 24, cathode driving circuit 25, image control circuit 27, and memory circuit 28. The input terminal 26 then receives an electrical signal including image data and control information from the personal computer or other external device (not shown), and supplies the input signal to the image control circuit 27.

The control information in the input signal indicates whether or not to store new image data in the memory circuit 28. For example, the input signal may include a control bit that is high when new image data are to be stored. When this control bit is high, the image control circuit 27 proceeds to receive the new image data from the input terminal 26 and writes the new image data in the memory circuit 28.

(2) After being stored in the memory circuit 28, the image data are read and displayed as follows.

When no input signal is received at the input terminal 26, or when a signal is received but the above-mentioned control bit is low, indicating that new image data are not to be stored in the memory circuit 28, the image control circuit 27 reads out the image data already stored in the memory circuit 28 and feeds the image data into the shift register in the anode driving circuit 24. The image data are shifted into the shift register until the image data for one scan line are stored in the shift register. A scan line comprises the thin-film LEDs 12 connected to one cathode line in the cathode wiring 14, aligned in a single horizontal row in FIG. 1.

The image control circuit 27 now sends the anode driving circuit 24 a control signal that loads the image data from the shift register into the latch circuits of the anode driving circuit 24, and sends the cathode driving circuit 25 a control signal causing it to select (i.e., sink current from) the appropriate cathode line in the cathode wiring 14 (FIG. 1). The data held in the latch circuits in the anode driving circuit 24 control the constant current and amplifier circuitry so as to supply current to the anodes of the LEDs connected to this cathode line that are to emit light. The supplied current flows through these thin-film LEDs 12, causing them to display the latched image data by emitting light, and is sunk by the cathode driving circuit 25.

After a predetermined interval, during which the image data for the next scan line are shifted into the shift register in the anode driving circuit 24, the new image data are latched, the cathode driving circuit 25 selects the next cathode line, and the latched data are displayed by the LEDs 12 attached to this cathode line. This operation continues until all scan lines have been selected, completing the display of one full-screen image; then the entire reading and display process starts again. Display of the same image continues until new image data are received at the input terminal 26, or until a control signal turning the display off is received or the power supply 29 is switched off.

The charging operation is carried out as follows.

Besides receiving the electrical signal that includes image data and control information, the input terminal 26 receives electrical power such as the five-volt power provided by a universal serial bus. The received power is supplied to the power supply 29 and charges the power supply 29 regardless of whether its switch (not shown) is on or off.

In the information display apparatus described above, since the LEDs and their wiring interconnections are formed by semiconductor fabrication processes, the LEDs can be integrated at an extremely high density. The information display apparatus can therefore provide a dense pixel matrix that delivers vastly improved image quality, and provides enough pixels for the display of intricate text and graphics on even small information display devices. In addition, since only a single cathode line is driven at a time, the display has comparatively low current consumption.

Second Embodiment

Figure 9:
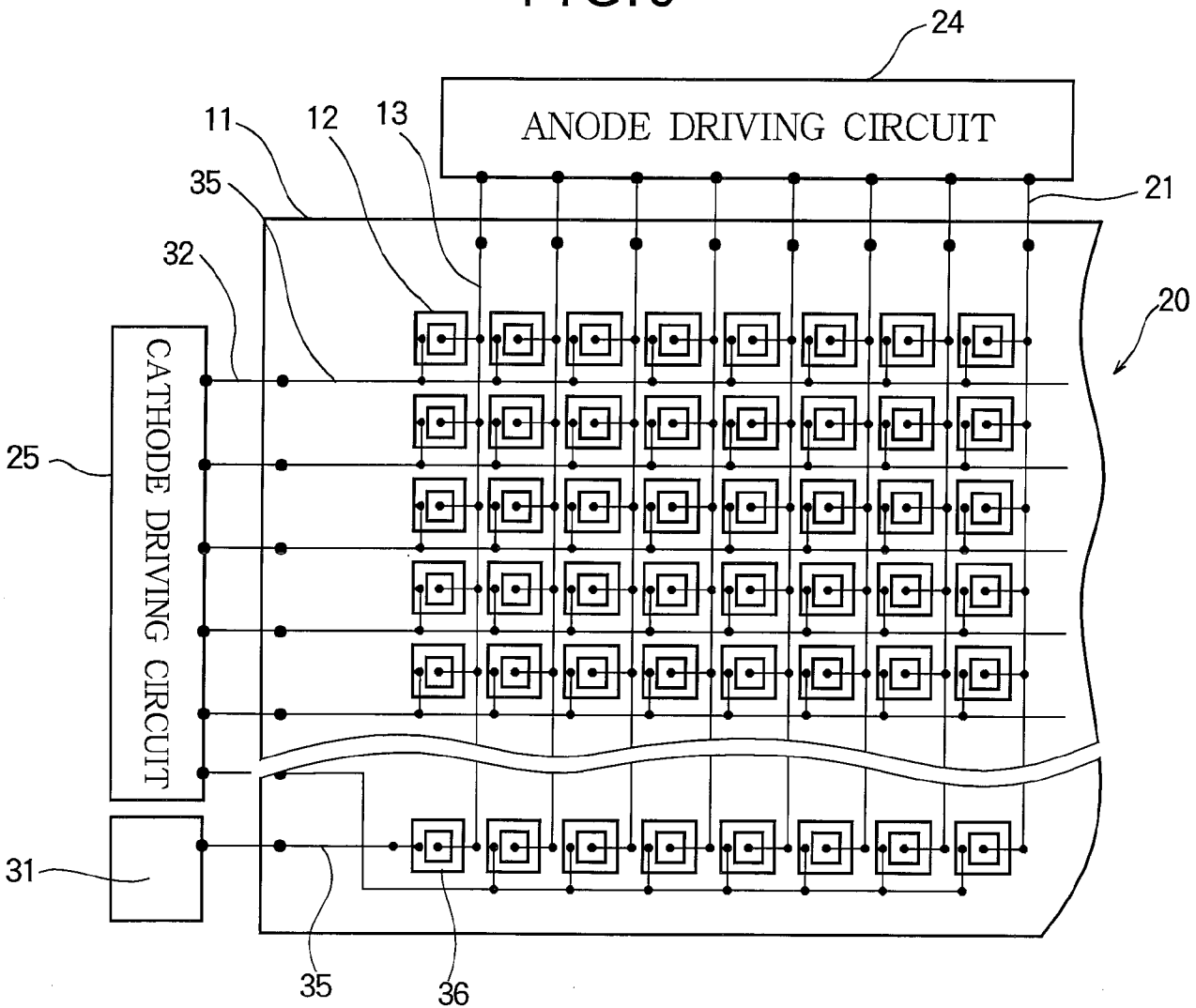
FIG. 9 is an enlarged plan view of a display panel according to a second embodiment of the invention.

Referring to FIG. 9, the display panel 20 of the second embodiment comprises a glass substrate 11, thin-film LEDs 12, anode wiring 13, and an anode wiring sheet 21 as described in the first embodiment, and also includes a cathode wiring sheet 32, cathode wiring 35, and a communication thin-film LED 36 that will be described below.

The cathode wiring 35 is a thin-film metal wiring pattern comprising cathode lines electrically connected to the cathodes of the thin-film LEDs 12 as in the first embodiment, and an additional cathode line electrically connected to the cathode of the communication thin-film LED 36.

The cathode wiring sheet 32 comprises copper thin-film wiring formed on an insulating film made of a material such as polyimide or polyester. One copper wire in the cathode wiring sheet 32 connects a modulator 31 (described later) to the cathode line 35 leading to the communication thin-film LED 36. The other copper wires in the cathode wiring sheet 32 connect a cathode driving circuit 25 to the cathode lines leading to the thin-film LEDs 12, as in the first embodiment.

The communication thin-film LED 36 is disposed at one of the four corners of LED matrix in the display panel 20, replacing one of the thin-film LEDs 12 in the matrix. The communication thin-film LED 36 emits light with the same wavelength as the other thin-film LEDs 12, but the light emitted by the communication thin-film LED 36 is frequency-modulated to transmit information to an external communication device (not shown).

Figure 10:
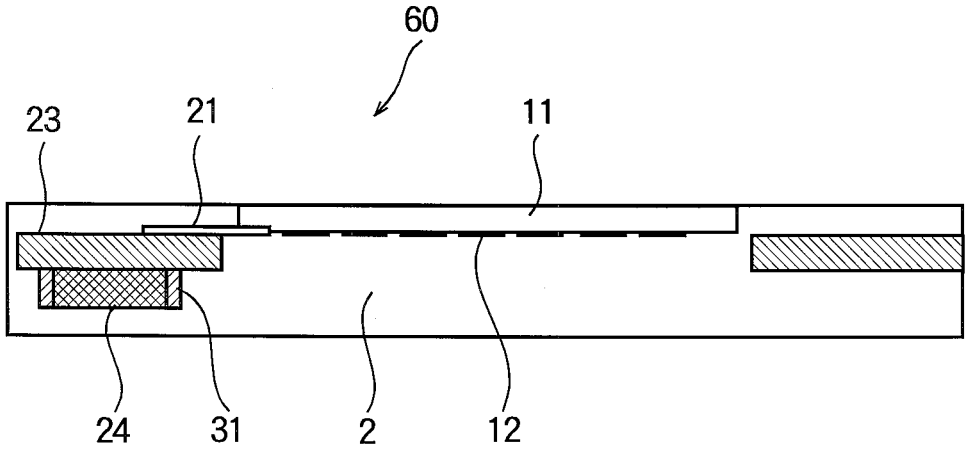
FIG. 10 is a sectional view of the information display apparatus in FIG. 9.
Figure 11:
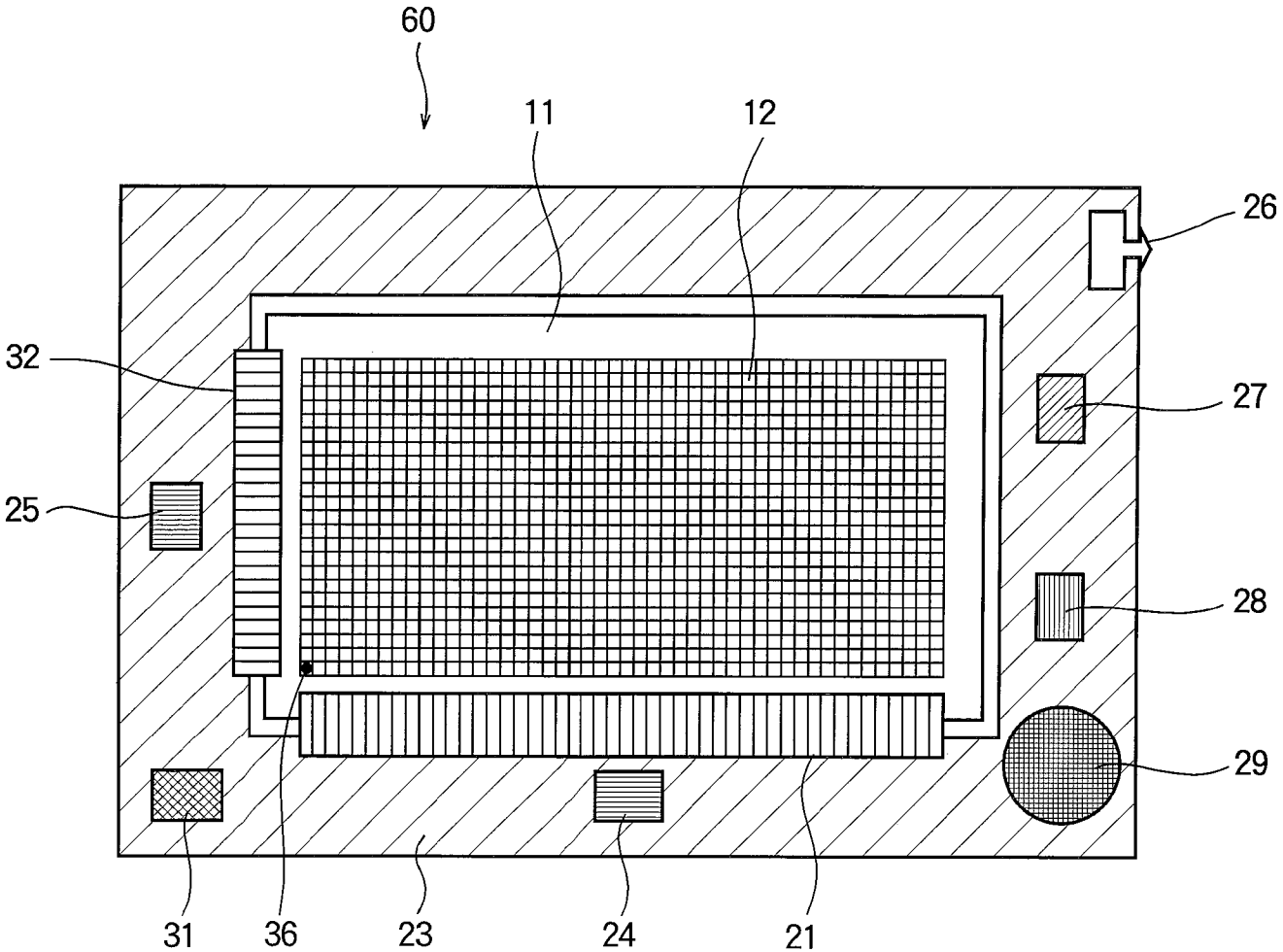
FIG. 11 is a plan view of the information display apparatus in FIG. 9 with its chassis removed.

Referring to FIGS. 10 and 11, the information display apparatus 60 of the second embodiment has the same general structure as in the first embodiment except for the addition of the modulator 31. FIG. 10 is a sectional view looking right to left in the plan view in FIG. 11, taken through the midline in FIG. 10 but also showing the modulator 31 as a background object partially obscured by the anode driving circuit 24. The anode driving circuit 24, cathode driving circuit 25, and modulator 31 are mounted, by soldering, for example, on the underside of a wiring board 23 held in a chassis 2. The anode driving circuit 24 is connected through via holes in the wiring board 23 to the anode wiring sheet 21. The cathode driving circuit 25 and modulator 31 are connected through via holes in the wiring board 23 to the cathode wiring sheet 32. An input terminal 26, image control circuit 27, memory circuit 28, and power supply 29 are also mounted and interconnected as in the first embodiment.

Figure 12:
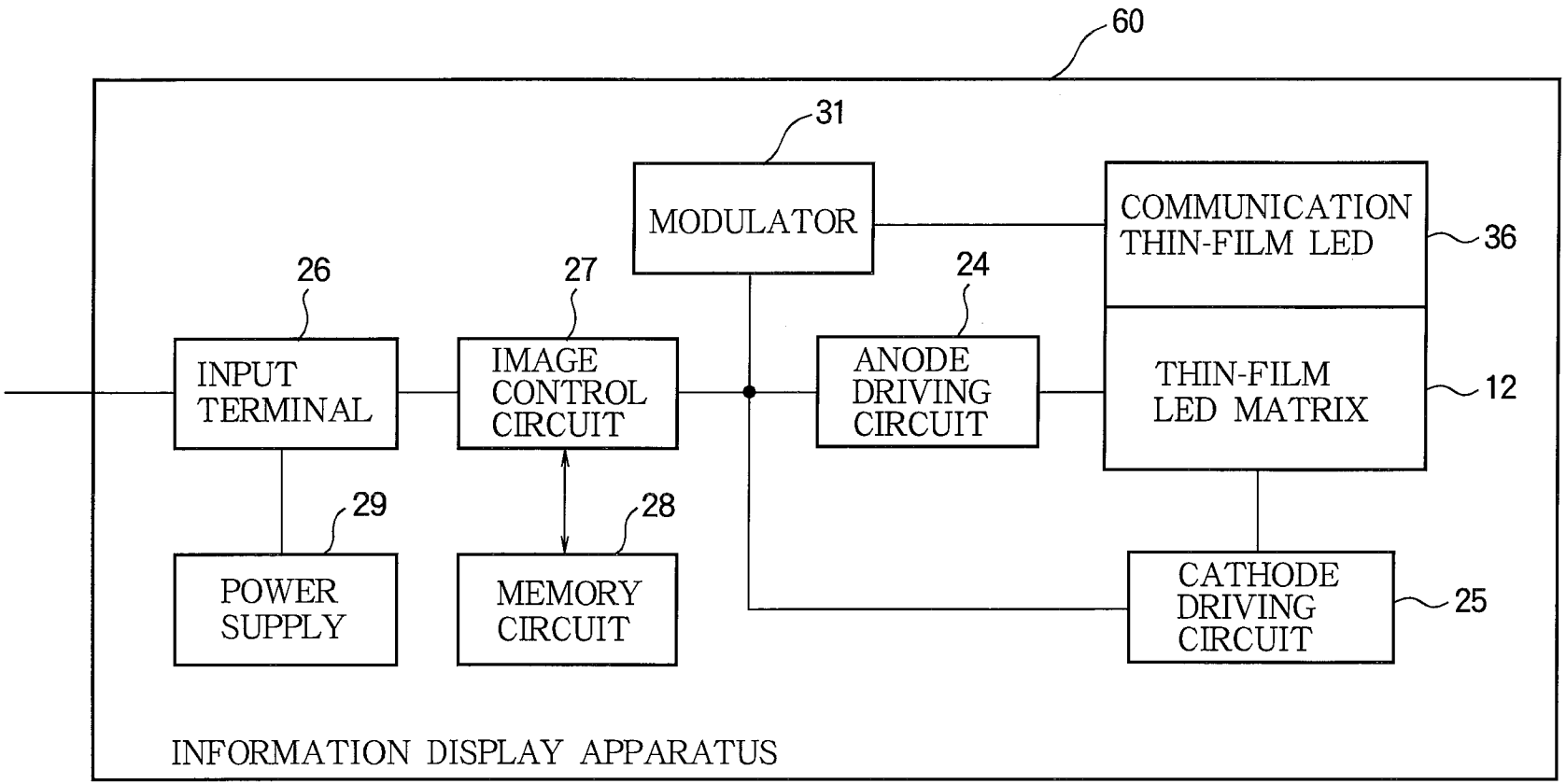
FIG. 12 is a circuit block diagram of the information display apparatus according to the second embodiment.

The interconnections among the thin-film LEDs 12, anode driving circuit 24, cathode driving circuit 25, input terminal 26, image control circuit 27, memory circuit 28, power supply 29, modulator 31, and communication thin-film LED 36 are illustrated by the block diagram in FIG. 12. The interconnections are the same as in the first embodiment except for the addition of the modulator 31 and communication thin-film LED 36. The anode driving circuit 24 has the same internal structure as in the first embodiment, comprising a shift register, latch circuits, and constant current and amplifier circuitry.

The modulator 31 receives communication data from the image control circuit 27 and sinks current from the communication thin-film LED 36 in a corresponding frequency-modulated pattern, thereby converting the communication data to a frequency-modulated light signal that can be received by the external communication device mentioned above.

The operation of the information display apparatus 60 will be described with reference to FIG. 12. The operations of the information display apparatus 60 include: (1) storing image and communication data in the memory circuit 28; (2) reading image data from the memory circuit 28 and driving the thin-film LEDs 12; (3) charging the power supply 29 from an external power supply; and (4) reading communication data from the memory circuit 28 and driving the communication thin-film LED 36. The charging operation (3) takes place as described in the first embodiment will not be described again.

(1) Image and communication data are stored in the memory circuit 28 as follows.

First, the power supply 29 is switched on to supply power to the anode driving circuit 24, cathode driving circuit 25, image control circuit 27, memory circuit 28, and modulator 31. The input terminal 26 then receives an electrical signal including image data, communication data, and control information from a personal computer or other external device (not shown), and supplies the input signal to the image control circuit 27. The input electrical signal is preferably a USB signal, and is received together with a 5-V power supply.

The input signal includes control information indicating whether or not to store data in the memory circuit 28. Separate control information may be provided for storing image data and communication data. When data of either type are to be stored, the image control circuit 27 receives the data from the input terminal 26 and writes the received data in the memory circuit 28.

(2) After being stored in the memory circuit 28, image data are read and displayed substantially as in the first embodiment. When no input signal is received at the input terminal 26, or when a signal is received but the above-mentioned control information indicates that no new image data are to be stored in the memory circuit 28, the image control circuit 27 loads the image data already stored in the memory circuit 28 into the anode driving circuit 24, one scan line at a time, and the anode driving circuit 24 and cathode driving circuit 25 cooperate to drive the thin-film LEDs 12 in each scan line to display the loaded image data. If the image data include data to be displayed at the position of the communication thin-film LED 36, these data are also loaded into the anode driving circuit 24.

(4) After being stored in the memory circuit 28, communication data are read and transmitted as follows.

The image control circuit 27 reads the communication data from the image control circuit 27 and sends the communication data to the modulator 31 while the cathode driving circuit 25 is scanning the thin-film LEDs 12 in the same horizontal scan line as the communication thin-film LED 36. During this interval, the anode driving circuit 24 supplies current to the communication thin-film LED 36 according to the latched image data, and the modulator 31 generates a frequency-modulated signal by switching the cathode of the communication thin-film LED 36 between two voltage levels at a frequency modulated according to the communication data. The communication thin-film LED 36 emits different amounts of light depending on its cathode voltage. The communication thin-film LED 36 thereby emits light that represents a pixel in the displayed image but is frequency-modulated and also carries communication information.

The frequency-modulated light is received by an external device (not shown), converted to an electrical signal, and demodulated to obtain the transmitted communication information.

The information display apparatus 60 of the second embodiment provides the same benefits as the information display apparatus of the first embodiment in terms of improved image quality, and can further enhance the value of the displayed image by transmitting related information. For example, if the information display apparatus 60 is used as a shelf display and the displayed image indicates the price of a product, the communication data might indicate the place of origin of the product.

Third Embodiment

Figure 13:
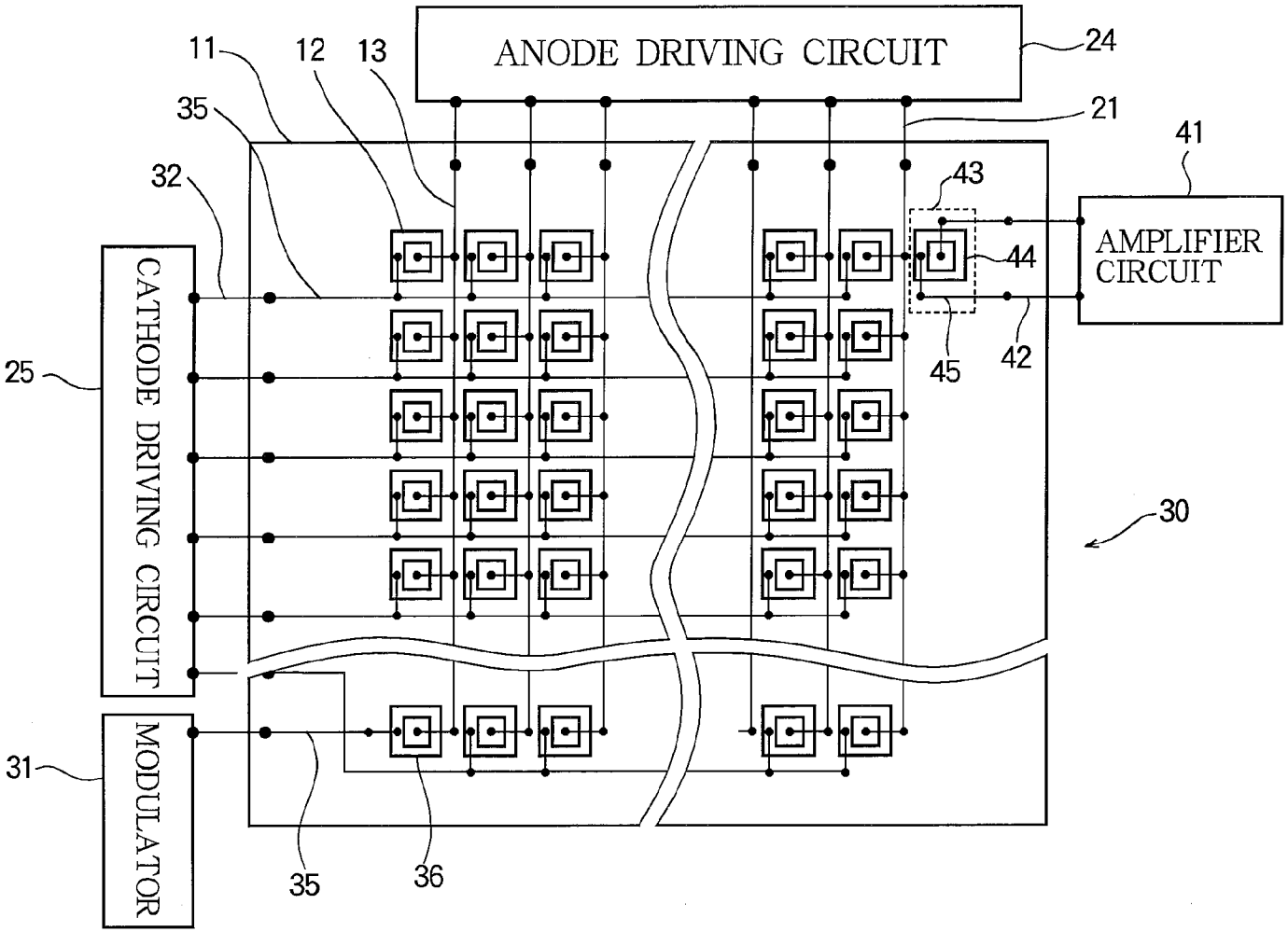
FIG. 13 is an enlarged plan view of a display panel according to a third embodiment.

Referring to FIG. 13, the display panel 30 of the third embodiment comprises a glass substrate 11, thin-film LEDs 12, anode wiring 13, an anode wiring sheet 21, a cathode wiring sheet 32, cathode wiring 35, and a communication thin-film LED 36 as described in the first and second embodiments, and a sensor wiring sheet 42, a light blocking filter 43, a photosensor 44, and sensor wiring 45, which will be described below.

The light blocking filter 43 is mounted on the surface of the glass substrate 11 opposite to the surface on which the thin-film LEDs 12 are formed, to attenuate sunlight and other ambient visible light. The photosensor 44 is an infrared light-receiving element such as a PIN diode formed on the same surface of the glass substrate 11 as the thin-film LEDs 12, facing the light blocking filter 43. The photosensor 44 may be formed in substantially the same way as the thin-film LEDs 12. The sensor wiring sheet 42 comprises a pair of copper thin-film interconnecting lines formed on an insulating film made of a material such as polyimide or polyester, and connects the sensor wiring 45 to an amplifier circuit 41, described later. The sensor wiring 45 comprises a pair of thin-film electrical paths formed on the glass substrate 11, connecting the photosensor 44 to the sensor wiring sheet 42.

Figure 14:
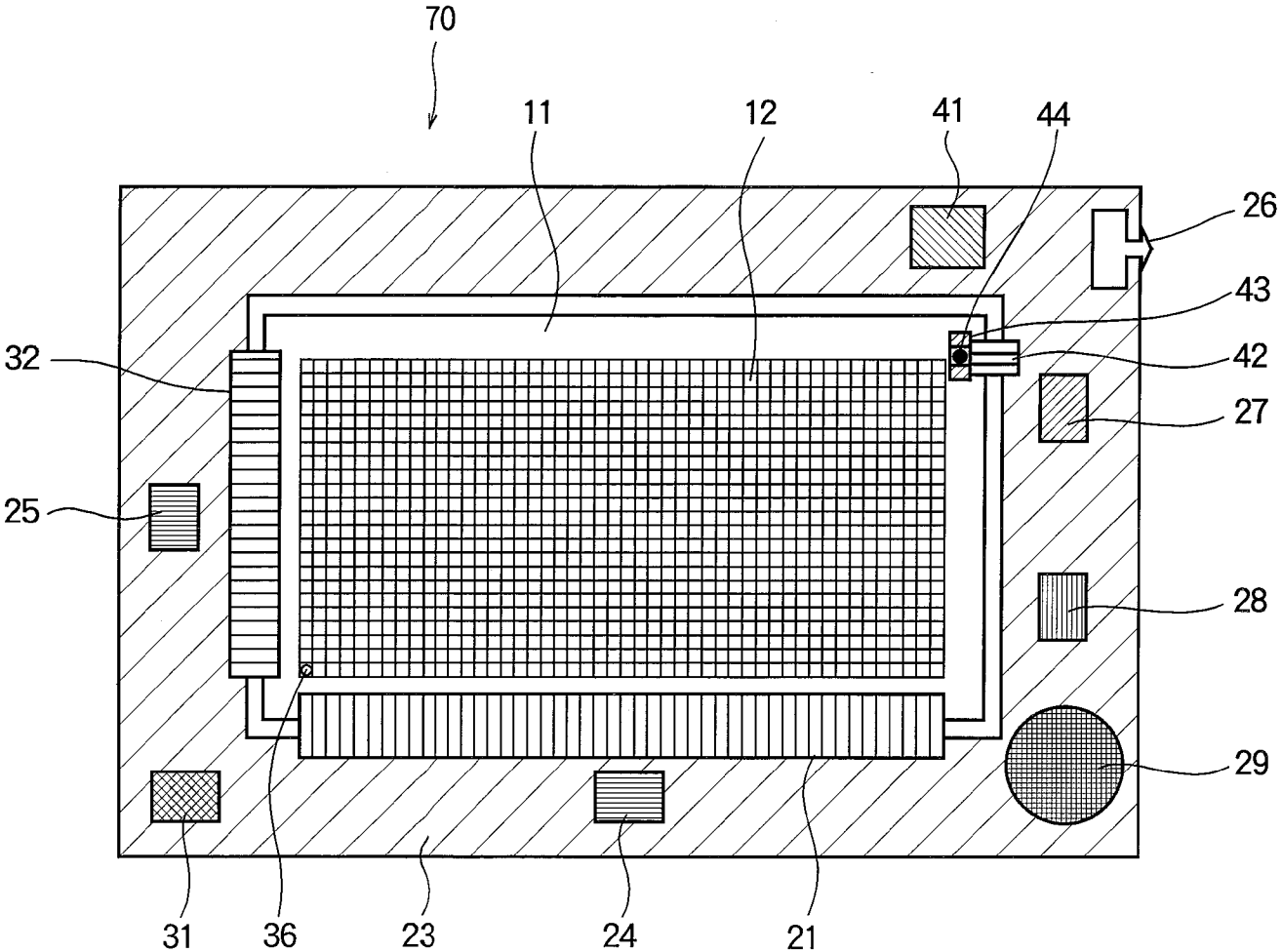
FIG. 14 is a plan view of the information display apparatus in FIG. 13 with its chassis removed.

Referring to FIG. 14, the information display apparatus 70 in the third embodiment has the same plan-view appearance as in the second embodiment, except for the addition of the amplifier circuit 41, sensor wiring sheet 42, light blocking filter 43, and photosensor 44. The amplifier circuit 41 is mounted on the wiring board 23 and connected to the image control circuit 27 and sensor wiring sheet 42 by wiring (not shown) on the wiring board 23.

Figure 15:
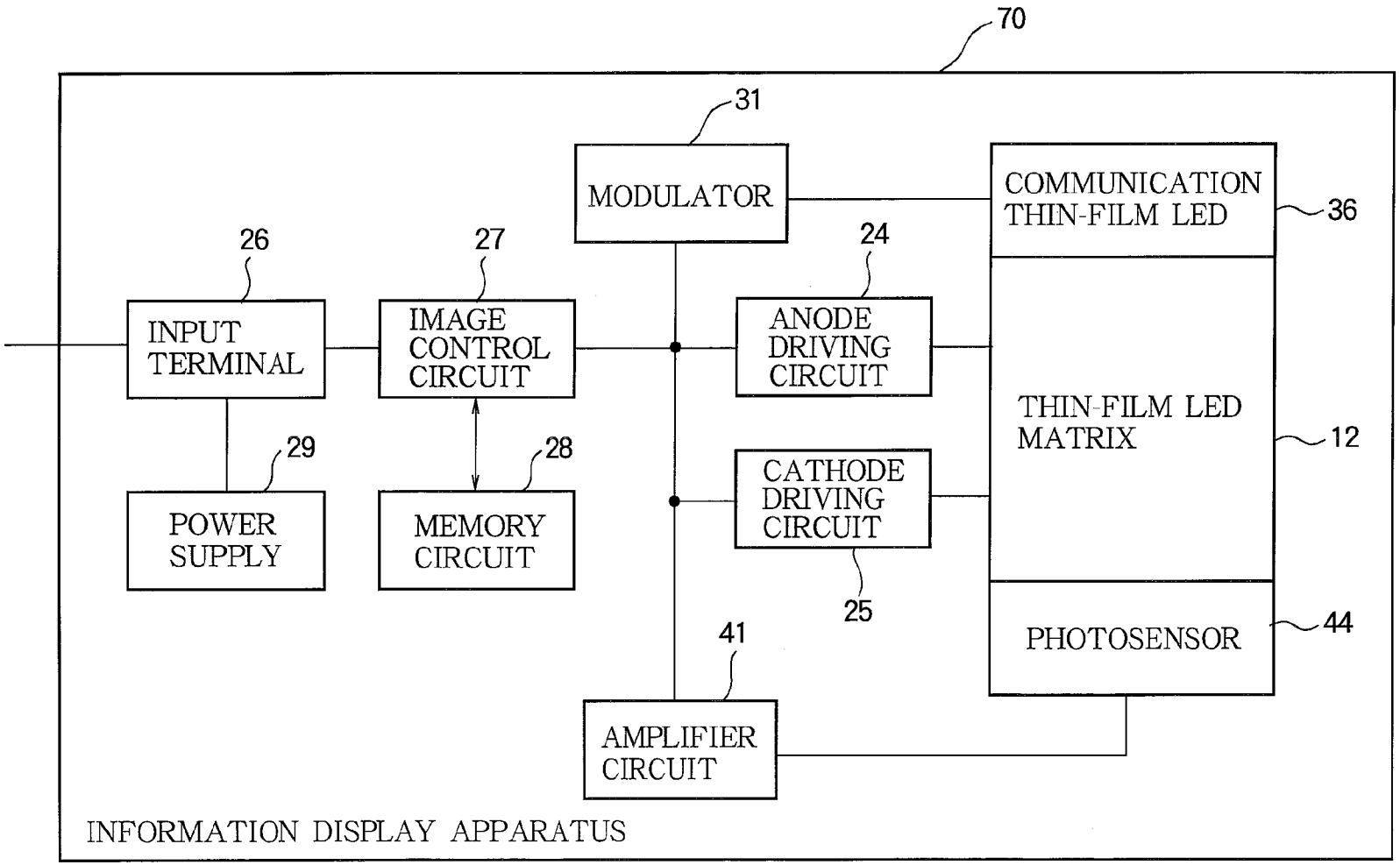
FIG. 15 is a circuit block diagram of the information display apparatus in FIG. 13.

FIG. 15 illustrates the interconnections among the thin-film LEDs 12, anode driving circuit 24, cathode driving circuit 25, input terminal 26, image control circuit 27, memory circuit 28, power supply 29, modulator 31, communication thin-film LED 36, amplifier circuit 41, and photosensor 44. The interconnections are as described in the first and second embodiments except for the addition of the amplifier circuit 41 and photosensor 44.

The photosensor 44 receives an infrared light signal and outputs a corresponding electrical signal to the amplifier circuit 41. The amplifier circuit 41 amplifies and digitizes the electrical signal and sends the resulting digital signal to the image control circuit 27.

The operation of the information display apparatus 70 will be described with reference to FIG. 15. The operations of the information display apparatus 70 include: (1) storing image and communication data received at the input terminal 26 in the memory circuit 28; (2) reading image data from the memory circuit 28 and driving the thin-film LEDs 12; (3) charging the power supply 29 from an external power supply; (4) reading communication data from the memory circuit 28 and driving the communication thin-film LED 36; and (5) storing image and communication data received at the photosensor 44 in the memory circuit 28. The first four of these operations are carried out as described in the first and second embodiments. The storing of image and communication data received by the photosensor 44 will be described below.

First, the power supply 29 is switched on to supply power to the image control circuit 27, memory circuit 28, anode driving circuit 24, cathode driving circuit 25, modulator 31, and amplifier circuit 41. Modulated infrared light is received from an external device (not shown). The infrared light is coded and includes the same type of information as received at the input terminal 26: image data, communication data, and control information indicating whether or not to store the received data. The infrared light passes through the light blocking filter 43 to the photosensor 44. While passing infrared light, the light blocking filter 43 attenuates visible light, so that the photosensor does not respond to changes in normal ambient light.

The photosensor 44 generates a voltage signal responsive to the intensity of the received infrared light. The voltage signal is amplified by the amplifier circuit 41 and converted from analog to digital form. The amplifier circuit 41 is adjusted for zero output when the photosensor 44 receives only attenuated ambient visible light.

The amplified and digitized signal output from the amplifier circuit 41 is input to the image control circuit 27. The control information in the input signal indicates various actions to be taken. For example, the control information '1010' (high-low-high-low) may indicate that the control information is followed by image data and communication data which are to be stored. When this control information is received, the image control circuit 27 writes the following image data and communication data in the memory circuit 28.

Other operations are performed as in the second embodiment. The thin-film LEDs 12 on the display panel 30 display image data read from the memory circuit 28. The communication thin-film LED 36 on the display panel 30 emits light that is frequency-modulated by the modulator 31 according to communication data read from the memory circuit 28. Both the image data and the communication data may have been received via the input terminal 26 as in the second embodiment, or either or both types of data may have been received via the photosensor 44 and amplifier circuit 41. The third embodiment accordingly permits wireless updating of the content of the image display and the content of the data transmitted by the communication thin-film LED 36. For example, the data can be updated with a hand-held remote control unit.

The information display apparatus 70 of the third embodiment is therefore particular suited for the display of information that cannot be completely managed by central control, but sometimes needs to be checked and updated on the spot. Product information in a store and inventory information in a warehouse are just two of many possible applications.

In a variation of the third embodiment, the input terminal 26 is used for both input and output, enabling the image control circuit 27 to transmit information received by the photosensor 44 to a central control apparatus.

Although the embodiments have a matrix of inorganic LED pixels disposed on a glass substrate, the invention can also be practiced with a matrix of organic LED (O-LED) pixels, also referred to as electroluminescence (EL) pixels, disposed on an organic substrate.

Those skilled in the art will recognize that further variations are possible within the scope of the invention, which is defined in the appended claims.

What is claimed is:

1. An information display apparatus comprising:

a plurality of thin-film light-emitting diodes (LEDs) disposed in a matrix on a surface of a transparent substrate, the LEDs having respective anodes and cathodes;

a plurality of anode thin-film electrical paths connected to the anodes of the plurality of thin-film LEDs;

a plurality of cathode thin-film electrical paths connected to the cathodes of the plurality of thin-film LEDs;

an anode driving circuit for controllably supplying current to the thin-film LEDs through the plurality of anode thin-film electrical paths;

a cathode driving circuit for controllably sinking current from the thin-film LEDs through the plurality of cathode thin-film electrical paths; and a communication thin-film LED disposed on the surface of the transparent substrate;

wherein the plurality of thin-film LEDs are driven to emit light according to image data representing an image to be displayed by the thin-film LEDs; and the communication thin-film LED is driven to emit light according to communication data separate from the image data the light emitted b the communication thin-film LED being received by an external communication device, and converted to communication information.

2. The information display apparatus of claim 1, wherein:

the matrix has a plurality of rows and a plurality of columns;

each of the plurality of anode thin-film electrical paths is connected to the anode electrodes of the thin-film LEDs in one column of the matrix; and each of the plurality of cathode thin-film electrical paths is connected to the cathode electrodes of the thin-film LEDs in one row of the matrix.

3. The information display apparatus of claim 1, wherein the thin-film LEDs emit light through the transparent substrate.

4. The information display apparatus of claim 1, wherein the transparent substrate includes an insulating film planarized to a flatness tolerance of less than one hundred nanometers, formed between the transparent substrate and the thin-film LEDs.

5. The information display apparatus of claim 1, wherein the plurality of thin-film LEDs comprise an epitaxially grown semiconductor material formed on a semiconductor substrate, detached from the semiconductor substrate, and anchored to the surface of the transparent substrate.

6. The information display apparatus of claim 5, wherein the epitaxially grown semiconductor material is anchored to the surface of the transparent substrate by intermolecular forces.

7. The information display apparatus of claim 5, wherein the epitaxially grown semiconductor material is separated from the semiconductor substrate by removal of a sacrificial layer formed between the epitaxially grown semiconductor material and the semiconductor substrate, the sacrificial layer differing in composition from the semiconductor substrate.

8. The information display apparatus of claim 5, wherein the epitaxially grown material is anchored to the transparent substrate in strips, each strip being patterned into discrete LEDs by photolithography and etching after being anchored.

9. The information display apparatus of claim 1, wherein the plurality of thin-film LEDs include at least one of:

red LEDs for emitting light at a wavelength between 620 and 710 nanometers;

green LEDs for emitting light at a wavelength between 500 and 580 nanometers; and blue LEDs for emitting light at a wavelength between 450 and 500 nanometers.

10. The information display apparatus of claim 1, wherein the plurality of thin-film LEDs include:

red LEDs for emitting light at a wavelength between 620 and 710 nanometers;

green LEDs for emitting light at a wavelength between 500 and 580 nanometers; and blue LEDs for emitting light at a wavelength between 450 and 500 nanometers.

11. The information display apparatus of claim 1, further comprising:

a memory circuit;

an input terminal for receiving a first electrical signal including image data and control information; and a control circuit for storing the image data in the memory circuit according to the control information, reading the image data stored in the memory circuit, and controlling the anode driving circuit and the cathode driving circuit according to the image data.

12. The information display apparatus of claim 11, wherein the first electrical signal also includes the communication data, which the control circuit stores in the memory circuit and reads from the memory circuit, the information display apparatus further comprising:

a modulator for receiving the communication data from the control circuit and generating a modulated signal with a frequency modulated according to the communication data; and the communication thin-film LED is disposed on the surface of the transparent substrate, for receiving the modulated signal from the modulator and emitting light frequency-modulated according to the modulated signal.

13. The information display apparatus of claim 12, wherein the communication thin-film LED forms part of the matrix and the light emitted by the communication thin-film LED is emitted according to the image data and frequency-modulated according to the communication data.

14. The information display apparatus of claim 11, further comprising a photosensor for receiving an optical signal, converting the optical signal to a second electrical signal, and supplying the second electrical signal to the control circuit.

15. The information display apparatus of claim 14, wherein the optical signal further includes image data and control information, and the control circuit stores the image data included in the optical signal in the memory circuit according to the control information included in the optical signal.

16. The information display apparatus of claim 14, wherein the optical signal is an infrared signal, further comprising a filter for attenuating sunlight incident on the photosensor.

17. The information display apparatus of claim 11, further comprising a rechargeable battery for supplying power to the memory circuit, the control circuit, the anode driving circuit, and the cathode driving circuit.

18. The information display apparatus of claim 1, wherein an anode electrode of the communication thin-film LED is connected to the anode driving circuit; and a cathode electrode of the communication thin-film LED is connected to the cathode driving circuit.

19. The information display apparatus of claim 1, wherein the communication thin-film LED is disposed at an end of the transparent substrate.

20. The information display apparatus of claim 1, wherein the thin-film LEDs display the price of a product, and the communication thin-film LED outputs data indicating the place of origin of the product.

21. The information display apparatus of claim 1, wherein the communication thin-film LED is driven to emit light modulated according to the communication data.

* * * * *